United States Patent [19]

Noda et al.

[11] Patent Number: 4,551,650

[45] Date of Patent: Nov. 5, 1985

[54] FIELD-EMISSION ION SOURCE WITH SPIRAL SHAPED FILAMENT HEATER

[75] Inventors: Tamotsu Noda, Toyohashi; Hifumi Tamura, Hachioji; Hiroshi Okano, Ohta, all of Japan

[73] Assignee: Hitachi, Ltd., Tokyo, Japan

[21] Appl. No.: 443,642

[22] Filed: Nov. 22, 1982

[30] Foreign Application Priority Data

Nov. 24, 1981 [JP] Japan ..... 56-173288[U]

[51] Int. Cl.[4] ..... H01J 33/02; H01J 49/10

[52] U.S. Cl. ..... 313/362.1; 313/16; 313/230

[58] Field of Search ..... 313/230, 362.1, 336, 313/328, 232, 163, 16

[56] References Cited

U.S. PATENT DOCUMENTS 4,088,919 5/1978 Clampitt et al. ..... 313/362.1

4,367,429 1/1983 Wang et al. ..... 313/362.1

*Primary Examiner*—Palmer C. DeMeo

*Assistant Examiner*—Sandra L. O'Shea

*Attorney, Agent, or Firm*—Antonelli, Terry & Wands

[57] ABSTRACT

The field-emission-type ion source according to the present invention comprises an emitter tip, a heater, a reservoir which stores material to be ionized, an extracting electrode situated at the front end of the emitter tip, and a coating-layer which is refractory and anti-reactive with the material to be ionized and which is coated on at least the heater of the emitter tip and heater, in order to prevent their reactions with the material to be ionized.

7 Claims, 5 Drawing Figures

FIELD-EMISSION ION SOURCE WITH SPIRAL SHAPED FILAMENT HEATER

BACKGROUND OF THE INVENTION

The present invention relates to a field-emission-type ion source such as a liquid-metal ion source, and more particularly to the protection of the heater and emitter tip of such ion source against material to be ionized.

The field-emission-type ion source indicated in U.S. Pat. No. 4,088,919 shows high brightness and can obtain a point source ion beam. Thus, it is anticipated that such ion source will be applied to the microanalysis and ion micro-beam lithography fields.

FIG. 1A and FIG. 1B show the schematic diagrams of conventional field-emission-type ion sources. In FIG. 1A a Joule heating ion emitter made by welding a needle-shaped emitter tip 2 to the top end of a hairpin-shaped filament 1 is shown. In the ion emitter diagram FIG. 1B, a through-hole 11 is prepared in the center of a boat-shaped heater 1 and the emitter tip 2 is inserted in this hole 11 to be Joule heated.

Both ion emitters store their material to be ionized 3 at the intersection (reservoir) of the heater 1 and the emitter tip 2. By Joule heating, the heater 1 in the above situation melts the material to be ionized 3, and through the balance between gravity and surface tension, the melted material to be ionized 3 flows down towards the end of the emitter tip 2, wetting the end of the emitter tip 2. A high electric field is formed at the end of the emitter tip 2 due to the extracting voltage supplied between the emitter tip 2 and the extracting electrode (not shown in the figure). As a result, ions of the material to be ionized are extracted from the end of the emitter tip 2.

However, in these conventional field-emission-type ion sources, the heater 1 and the emitter tip 2 are consumed rapidly because both the heater 1 and the emitter tip 2 react with the material to be ionized 3 during the source operation. The consumption of the heater 1 which is sustained at high temperatures during the operation is especially fast in comparison to that of the emitter tip 2. This often caused the disconnection of the heater 1 in a very short time. As a result, only short-life ion sources were realized. Some sort of measure is anticipated to lengthen their lives.

SUMMARY OF THE INVENTION

The object of the present invention is, therefore, to provide a field-emission-type ion source with high brightness and long life.

In order to accomplish the above object, the field-emission-type ion source according to the present invention comprises an emitter tip with a needle-point end, a heater to heat the emitter tip and a material to be ionized, a reservoir located at the intersection of the emitter tip and the heater to store the material to be ionized, an extracting electrode situated at the front end of the emitter tip to extract the ions from the melted material to be ionized which wets the emitter tip, and a coating-layer which is made from a substance which is both refractory and anti-reactive to the material to be ionized and which is coated on at least the heater surface of the heater and the emitter tip, in order to prevent the material to be ionized from reacting with the heater and the emitter tip.

By using the characteristic structure mentioned above, such substances as B, P and As which are used as impurities in semiconductors and are reactive, can be used as the material to be ionized without causing reactions with the heater and the emitter tip. As a result, a field-emission-type ion source which can stably emit high brightness ion beams for long periods can now be produced.

DETAILED DESCRIPTION

First, the principle of this invention will be explained. Normally, high-melting point materials such as W, Ta, Mo and Re are used for the heater and the tip. At the same time, when the ion source is applied to an ion implanter used in the fabrication process of semiconductor devices, reactive substances such as B, P and As are used as the materials to be ionized. As a result, these reactive materials to be ionized react with the heater and the emitter tip during the operation, thus consuming and deteriorating the heater and the emitter tip, and making it difficult to extract ion beams for long periods. Therefore, according to the present invention, a coating-layer made from a refractory and anti-reactive substance is formed between the heater, the emitter tip and the material to be ionized, to prevent any reaction among them during the source operation.

Since the heater is sustained at higher temperatures in comparison with the emitter tip during the operation, it is found that even when the coating-layer is formed only around the heater, a highly satisfactory effect is obtained. For the coating-layer, oxides, nitrides, carbides and borides of such substances as aluminum are suitable.

Figure 1A:
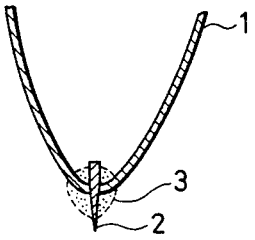
FIG. 1A PRIOR ART
FIG. 1A and FIG. 1B are both schematic diagrams of ion emitters in conventional field-emission-type ion sources.
Figure 1B:
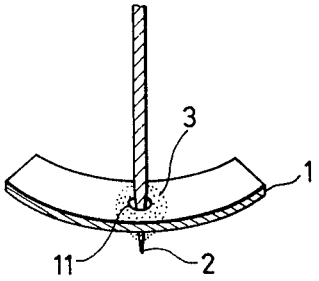
FIG. 1B PRIOR ART
Figure 2A:
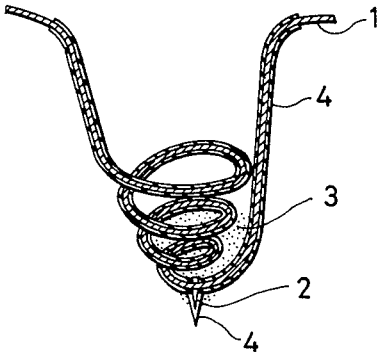
FIG. 2A and FIG. 2B are both schematic diagrams of ion emitters in the field-emission-type ion source according to the present invention.
Figure 2B:
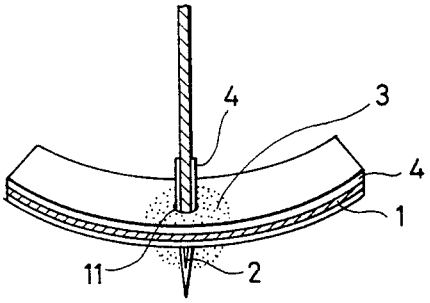

Next, actual examples of the present invention will be explained. Both FIG. 2A and FIG. 2B show schematic diagrams of the ion emitter for the field-emission-type ion source according to the present invention. In FIG. 2A, the ion emitter comprises a spiral-shaped filament heater 1, a needle-shaped emitter tip 2 which is welded to the bottom end of a filament heater 1, and a reservoir of material to be ionized 3 formed near a welded section between the filament heater 1 and the emitter tip 2. The characteristic point in the present embodiment is the existence of an aluminum coating-layer 4 on the surface of the filament heater 1 and the emitter tip 2.

The ion emitter in FIG. 2B comprises a boat-shaped heater 1, a through-hole 11 lcoated in the center of the heater 1, an emitter tip 2 which is inserted into the through-hole 11, and a reservoir of material to be ionized 3 formed around the through-hole 11 which is where the heater 1 and the emitter tip 2 intersect. The characteristic point in the present embodiment is that an aluminum coating-layer 4 covers the surfaces of the heater 1 and the emitter tip 2.

The above aluminum coating-layer 4 is formed around the surfaces of the heater 1 and the emitter tip 2 by the following method: A suspension liquid is made with fine aluminum particles and a binder, the heater 1 and the emitter tip 2 are immersed in this suspension liquid where aluminum is applied to their surfaces and they are then sintered in a high-temperature furnace. The thickness of the coating-layer can be controlled by changing the concentration of the suspension liquid.

In the embodiments shown in FIG. 2A and FIG. 2B, the heater 1 and the emitter tip 2 are both coated by the coating-layer 4. However, at minimum, the end of the emitter tip 2 need not be coated by the coating-layer 4 when such a necessity arises. That is, when the ion emitter uses the Joule heating method, the end of the emitter tip 2 can be kept at low temperatures in comparison with the heater 1. As a result, reactions between the emitter tip 2 and the material to be ionized 3 is controlled and the consumption of the emitter tip 2 is reduced.

Figure 3:
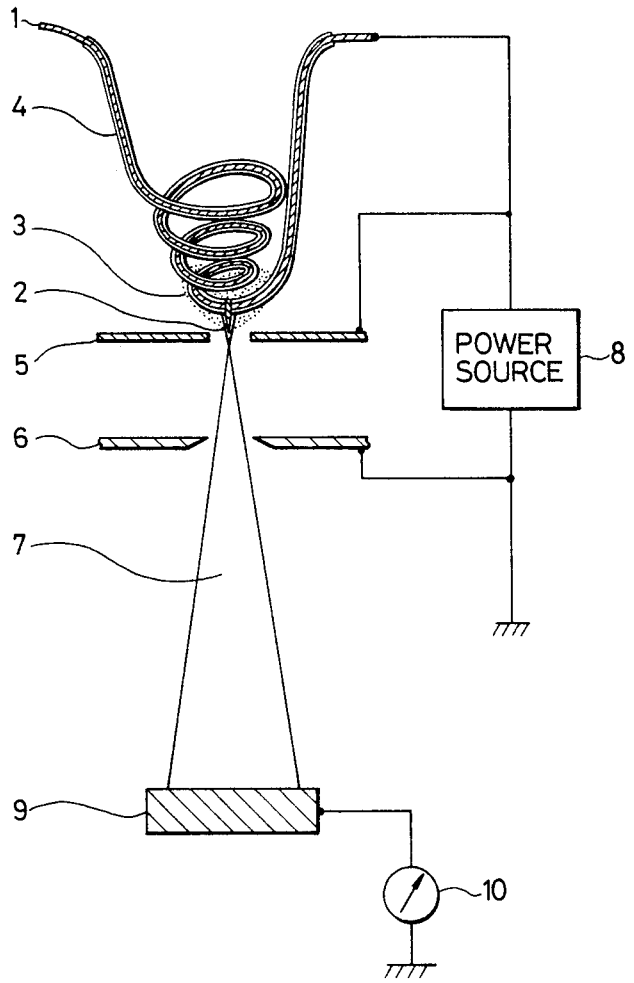
FIG. 3 is a schematic diagram of the entire field-emission-type ion source according to the present invention.

FIG. 3 shows a schematic diagram of a field-emission-type ion source using the ion emitter shown in FIG. 2A. This ion source comprises a heater 1 and a emitter tip 2 which are both coated by an aluminum coating-layer 4, a reservoir formed around the welded section between the heater 1 and the emitter tip 2, a material to be ionized 3 stored in the reservoir, a control electrode 5 which is located near the emitter tip 2, an extracting electrode 6 situated at the front end of the emitter tip 2 and a high-voltage power supply 8 which produces a large electric field at the end of the emitter tip 2.

The principle of the ion source operation will be explained next. The material to be ionized 3, from which will be extracted an ion beam 7, is stored in the reservoir of the spiral heater 1. An adequate electric current is applied to the heater 1 which then heats the emitter tip 2 and the material to be ionized 3. The material to be ionized 3 which is melted by heat and kept in balance by gravity and surface tension flows down the emitter tip 2 and wets its end. By applying the high-voltage power supply 8 to the above conditions, the large electric field is produced in the vicinity of the end of the emitter tip 2, by the extracting electrode 6. As the intensity of the electric field near the end of the emitter tip 2 approaches a certain value, the material to be ionized 3 which is wetting the end of the emitter tip 2 is ionized and is extracted as the ion beam 7. The electric current of this ion beam 7 is measured by a target 9 and a micro-ammeter 10 which is connected to the target 9.

In such an ion source, a Ga ion beam 7 of approximately 20 $\mu$A was stably obtained for a long period when the radius of the end of the emitter tip 2 was 2–5 $\mu$m, the material to be ionized 3 was GaAs and the extracting voltage was +10 keV. When the extracting voltage was −10 keV with the other conditions unchanged, an As ion beam 7 of approximately 10 $\mu$A was stably obtained for a long period.

Although in the above embodiments aluminum was used for the coating-layer 4, oxides, nitrides, carbides and borides which are refractory and anti-reactive can also be used.

As described above, because the heater and the emitter tip have refractory and anti-reactive coating-layers between them and the material to be ionized, any reaction is prevented. As a result, ion beams of reactive materials to be ionized such as B, P and As which were once considered to be difficult to produce can now be produced easily and stably for long periods by this field-emission-type ion source.

We claim:

1. A field-emission-type ion source comprising a needle-pointed emitter tip, a heater for heating said emitter tip and a material to be ionized, said heater being made from a spiral-shaped filament heater which is welded to said emitter tip, a reservoir set at the intersection of said emitter tip and said heater to store said material to be ionized, an extracting electrode situated at the front end of said emitter tip to extract ions of said material to be ionized from the end of said emitter tip which is wet by said melted material to be ionized, and a coating-layer which is made from a refractory substance which is anti-reactive with said material to be ionized and which is coated on the surface of said heater and said emitter tip, in order to prevent their reactions with said material to be ionized.

2. A field-emission-type ion source defined in claim 1 wherein said coating-layer is made from aluminum.

3. A field-emission-type ion source defined in claim 1, wherein said heater is positioned adjacent said emitter tip such that said heater heats the emitter tip.

4. A field-emission-type ion source defined in claim 1, wherein the heater and emitter tip are each made of a material selected from the group consisting of W, Ta, Mo and Re.

5. A field-emission-type ion source defined in claim 4, wherein the material to be ionized is selected from the group consisting of As, B and P.

6. A field-emission-type ion source comprising a needle-pointed emitter tip, a heater for heating said emitter tip and a material to be ionized, said heater being made from a spiral-shaped filament heater which is welded to said emitter tip, a reservoir set at the intersection of said emitter tip and said heater to store said material to be ionized, an extracting electrode situated at the front end of said emitter tip to extract ions of said material to be ionized from the end of said emitter tip which is wet by said melted material to be ionized, and a coating-layer which is made from a refractory substance which is anti-reactive with said material to be ionized and which is coated on the surface of said heater, in order to prevent the reaction thereof with said material to be ionized.

7. A field-emission-type ion source defined in claim 6, wherein said heater is positioned adjacent said emitter tip such that said heater heats the emitter tip.

* * * * *